US011897664B2

(12) United States Patent
Harris et al.

(10) Patent No.: US 11,897,664 B2
(45) Date of Patent: Feb. 13, 2024

(54) CONTAINER WITH CIRCUMFERENTIAL DRINKING OPENINGS

(71) Applicant: Base Brands, LLC, Atlanta, GA (US)

(72) Inventors: Jamison Corey Harris, Brookhaven, GA (US); Patrick Spivey, Atlanta, GA (US); Kenneth Kreafle, Atlanta, GA (US)

(73) Assignee: Base Brands, LLC, Atlanta, GA (US)

( * ) Notice: Subject to any disclaimer, the term of this patent is extended or adjusted under 35 U.S.C. 154(b) by 0 days.

(21) Appl. No.: 17/829,074

(22) Filed: May 31, 2022

(65) Prior Publication Data

US 2023/0382605 A1 Nov. 30, 2023

(51) Int. Cl.
*B65D 43/02* (2006.01)
*A47G 19/22* (2006.01)

(52) U.S. Cl.
CPC ..... *B65D 43/0225* (2013.01); *A47G 19/2211* (2013.01); *A47G 19/2272* (2013.01); *B65D 2543/00046* (2013.01); *B65D 2543/0049* (2013.01)

(58) Field of Classification Search
CPC ..... B65D 2543/00046; B65D 81/3869; A47G 19/2211; A47G 19/2272
See application file for complete search history.

(56) References Cited

U.S. PATENT DOCUMENTS 2,136,755 A * 11/1938 Prince ..... A47G 19/2211 210/469
D168,409 S * 12/1952 Kell ..... D7/524
2,761,301 A * 9/1956 Tellier ..... A47G 19/2211 220/719
3,313,447 A * 4/1967 Spencer ..... B65D 1/265 D7/510
3,360,160 A * 12/1967 Spencer ..... A47G 19/2211 D7/396.2
3,360,161 A * 12/1967 Smith ..... A47G 19/2272 D7/396.2
D226,443 S * 3/1973 Achenbach ..... D7/523
4,130,215 A * 12/1978 Corey ..... A47G 19/2205 D7/510
5,918,761 A * 7/1999 Wissinger ..... A47G 19/2288 220/713
D465,971 S * 11/2002 Renz ..... D7/509
D483,611 S * 12/2003 Diak Ghanem ..... D7/510
7,168,589 B2 * 1/2007 Dark ..... B65D 43/0229 220/711

(Continued)

OTHER PUBLICATIONS

Ornamin, "Ornamin Trinkdeckel" https://www.youtube.com/watch?v=oKPAp4UoINI, with transcript, retrieved Apr. 21, 2017.

*Primary Examiner* — John K Fristoe, Jr.
*Assistant Examiner* — Jennifer Castriotta
(74) *Attorney, Agent, or Firm* — Park, Vaughan, Fleming & Dowler LLP

(57) ABSTRACT

A drinking vessel with a lid containing circumferential drinking openings. In one embodiment, the drinking vessel includes a bowl and a lid, wherein the bowl is connected to the lid and wherein the drinking vessel includes a plurality of rotational orientations, and wherein the lid includes a plurality of drinking openings such that a user may drink from the drinking vessel substantially irrespective of its rotational orientation.

15 Claims, 7 Drawing Sheets

(56) References Cited

U.S. PATENT DOCUMENTS

| | | | | | |
|---|---|---|---|---|---|
| D729,013 | S * | 5/2015 | Riedel | | D7/524 |
| D735,532 | S * | 8/2015 | Zollweg | | D7/532 |
| 9,578,981 | B2 * | 2/2017 | Melton | A47G | 19/2255 |
| D828,096 | S * | 9/2018 | Moore | | D7/509 |
| 11,304,550 | B1 * | 4/2022 | Cosgarea | A47J | 41/028 |
| 2011/0309092 | A1 * | 12/2011 | Gatta | A47G | 19/2205 220/703 |
| 2017/0013985 | A1 * | 1/2017 | Fan | A47G | 19/2272 |

* cited by examiner

CONTAINER WITH CIRCUMFERENTIAL DRINKING OPENINGS

FIELD OF THE INVENTION

This disclosure generally relates to drinking vessels and, more specifically, to a drinking vessel with a lid containing circumferential drinking openings.

BACKGROUND

Drinking vessels, such as cups, insulated beverage containers, canteens, and the like are used to contain fluids for drinking. Fluids tend to spill if left in an open container, so many drinking vessels include a lid. Some lids include openings for allowing controlled passage of the fluid to a user of the vessel. In some cases, the opening is a hole or slot for receiving a drinking straw. In other cases the opening is located only on one side of the lid such that the vessel must be held in a single orientation when drinking from it lest the vessel's contents spill. Accordingly, it is one of the several objects of the present invention to provide a container with circumferential drinking openings so that a user may drink from the vessel irrespective of its orientation.

SUMMARY

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

Described herein are embodiments of an apparatus that include and/or consist of a drinking vessel with a lid containing circumferential drinking openings. In an embodiment, the apparatus may include a base, a stem, a bowl, and a lid, where the lid has a plurality of drinking openings spaced around its circumference. Additional embodiments and details of the invention are described below in the drawings and detailed description. The actual scope and bounds of the invention are set forth in the appended claims.

BRIEF DESCRIPTION OF THE DRAWINGS

The disclosure may be understood by reference to the following description taken in conjunction with the accompanying drawings, in which like reference numerals identify like elements, and in which.

Figure 1:
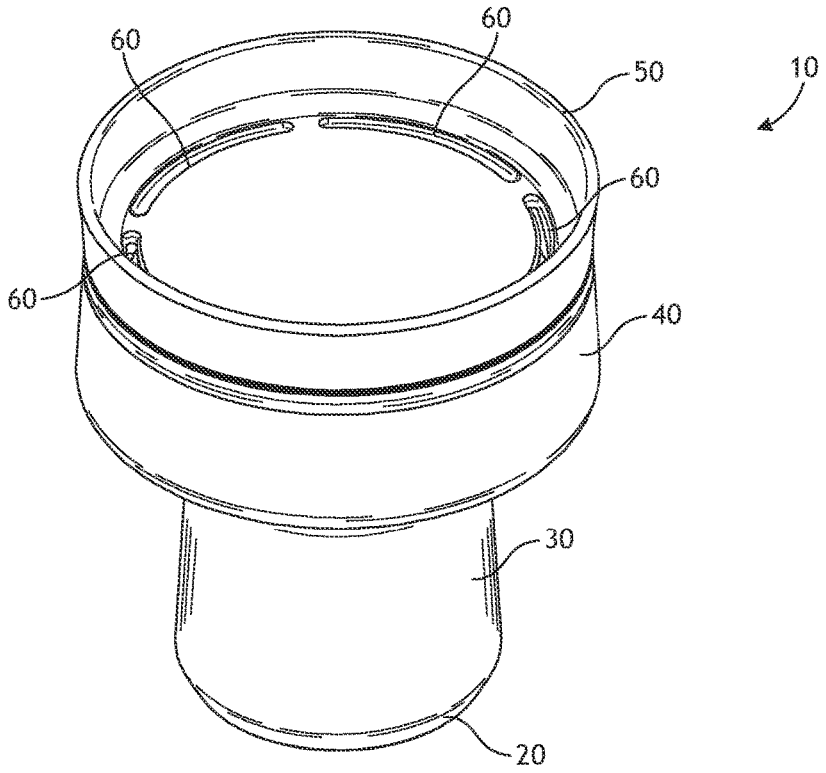
FIG. 1 is a front-side perspective view of one embodiment of a drinking vessel with a lid containing circumferential drinking openings.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the invention is to cover all modifications, equivalents, and alternatives falling within the spirit and scope of the invention as defined by the appended claims.

DETAILED DESCRIPTION

Various features and advantageous details are explained more fully with reference to the non-limiting embodiments that are illustrated in the accompanying drawings and detailed in the following description. Descriptions of well-known starting materials, processing techniques, components, and equipment are omitted so as not to unnecessarily obscure the invention. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

The present embodiments describe a drinking vessel with a lid containing circumferential drinking openings. FIG. 1 is a front-side perspective view of one such embodiment. As shown, combination 10 may include base 20, stem 30, bowl 40, and lid 50. As will be described in more detail below, an opening (not shown) on bowl 40 is sized to receive lid 50 in a sealing arrangement that substantially prevents the contents of bowl 40 from inadvertently escaping/spilling. It should be recognized that base 20, stem 30, and/or bowl 40 may be the same component.

Lid 50 further includes a plurality of drinking openings 60, which in this embodiment are arced slits arranged around a periphery of an outside circumference of lid 50. In this embodiment, a gap exists between each arc and each arc has a curvature equal to the other arcs. Those skilled in the art will appreciate that the number of arcs could differ, as could the size of the gap between them, and as could the degree of each arc (i.e., the effective length of the radius of each arc), as could their circumferential location on lid 50. The general idea, however, is that a user may sip from the vessel substantially irrespective of its rotational orientation.

Still further, FIG. 1 shows several additional optional features of the present invention, such as a depressed surface of lid 50 (i.e., lid 50 includes a raised rim around at least a portion of its outer circumference) that traps inadvertently spilled liquids. Still further, as better illustrated by the exemplary embodiments of FIGS. 4-7, base 20 includes at least a first and second circumference, where the second circumference is greater than the first circumference. Stem 30 includes at least a first and second circumference, where the second circumference is less than the first circumference and the first circumference is substantially equal to the second circumference of base 20. Bowl 40 includes at least a first and second circumference, where the second circumference is greater than the first circumference, and the first circumference is substantially equal to the second circumference of stem 30. Lid 50 includes at least a first and second circumference, where the second circumference is greater than the first circumference, and the first circumference is substantially equal to the second circumference of bowl 40. Each portion of combination 10 could have more or less circumferences and each could have different relative sizes. Indeed, the embodiments of FIGS. 4-7 illustrate some of those possibilities.

Base 20, stem 30, bowl 40, and/or lid 50 can be formed from separate components or the same unitary component. Likewise, each can be made from any suitable material, including vacuum-sealed layers to assist in preserving the temperature of the vessel's contents.

Figure 2:
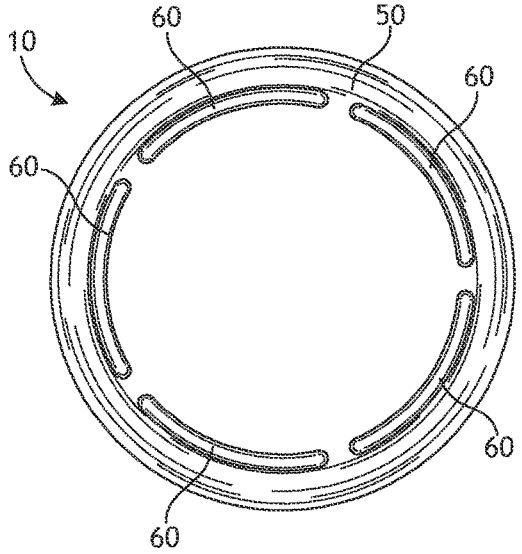
FIG. 2 is a top view of one embodiment of a drinking vessel with a lid containing circumferential drinking openings.
Figure 3:
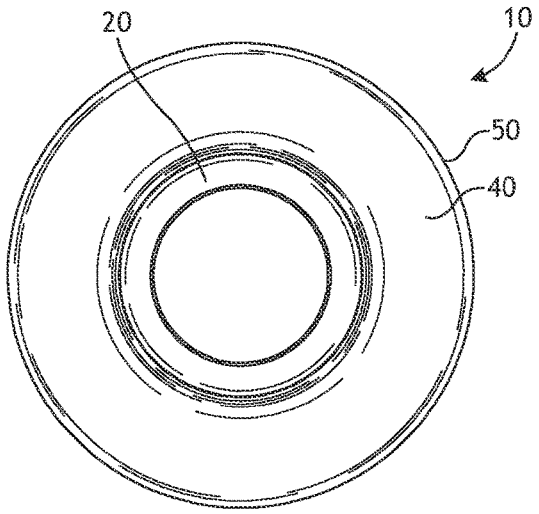
FIG. 3 is a bottom view of one embodiment of a drinking vessel with a lid containing circumferential drinking openings.
Figure 4:
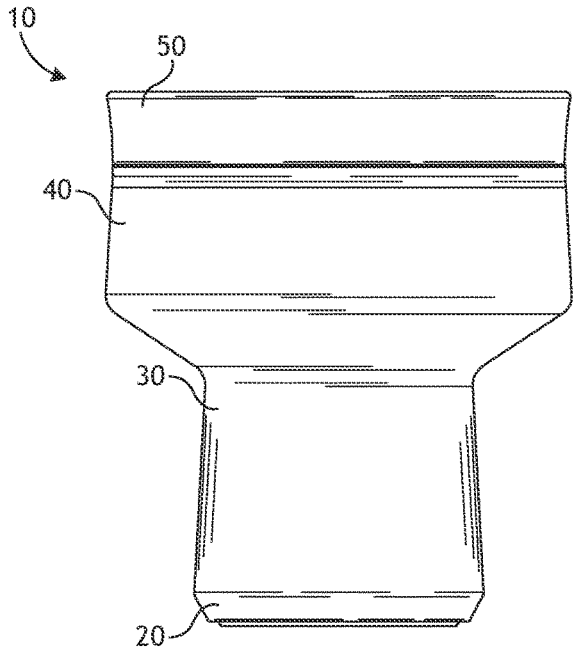
FIG. 4 is a back view of one embodiment of a drinking vessel with a lid containing circumferential drinking openings.
Figure 5:
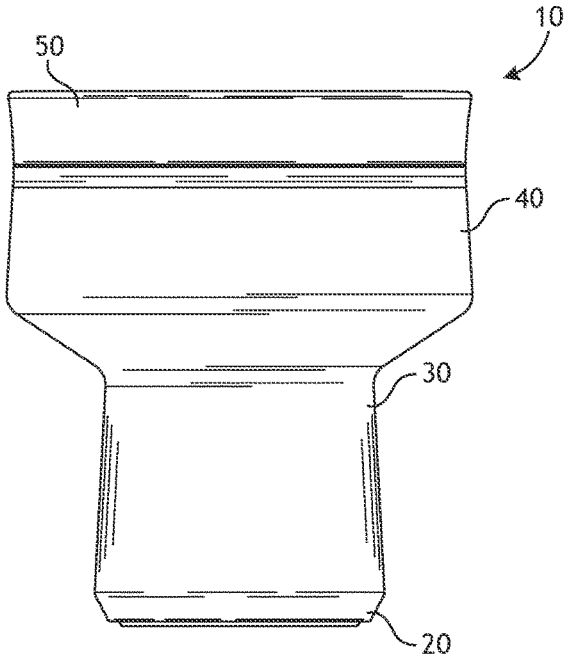
FIG. 5 is a front view of one embodiment of a drinking vessel with a lid containing circumferential drinking openings.
Figure 6:
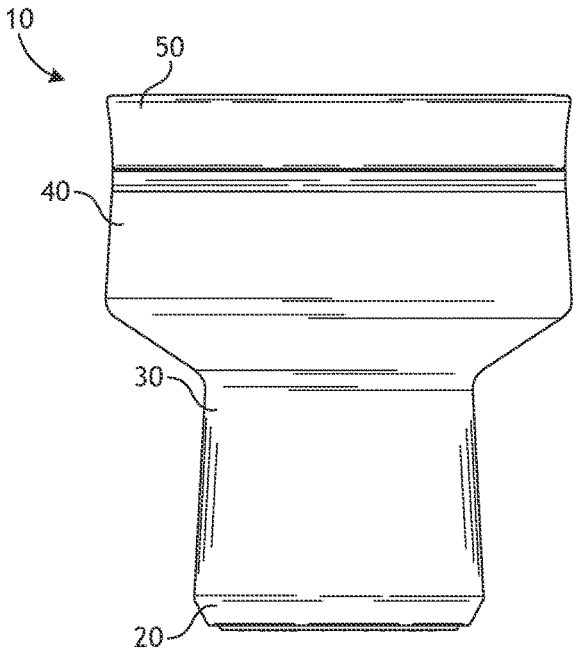
FIG. 6 is a left side view of one embodiment of a drinking vessel with a lid containing circumferential drinking openings.
Figure 7:
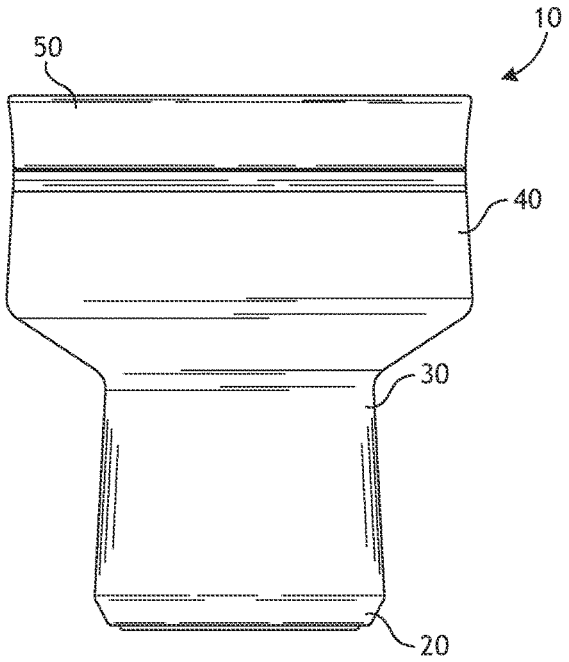
FIG. 7 is a right side view of one embodiment of a drinking vessel with a lid containing circumferential drinking openings.

FIG. 2 is a top view of one embodiment of a drinking vessel with a lid containing circumferential drinking openings. FIG. 2 better illustrates the embodiment in which lid 50 includes a plurality of drinking openings 60, which in this embodiment are arced slits arranged around a periphery of an outside circumference of lid 50. A indicated above, in this embodiment a gap exists between each arc, and each arc has a curvature equal to the other arcs. FIG. 3 is a bottom view of one embodiment of a drinking vessel with a lid containing circumferential drinking openings. FIG. 3 illustrates an embodiment where the second circumference of lid 50 is slightly larger than the second circumference of bowl 40.

Figure 8:
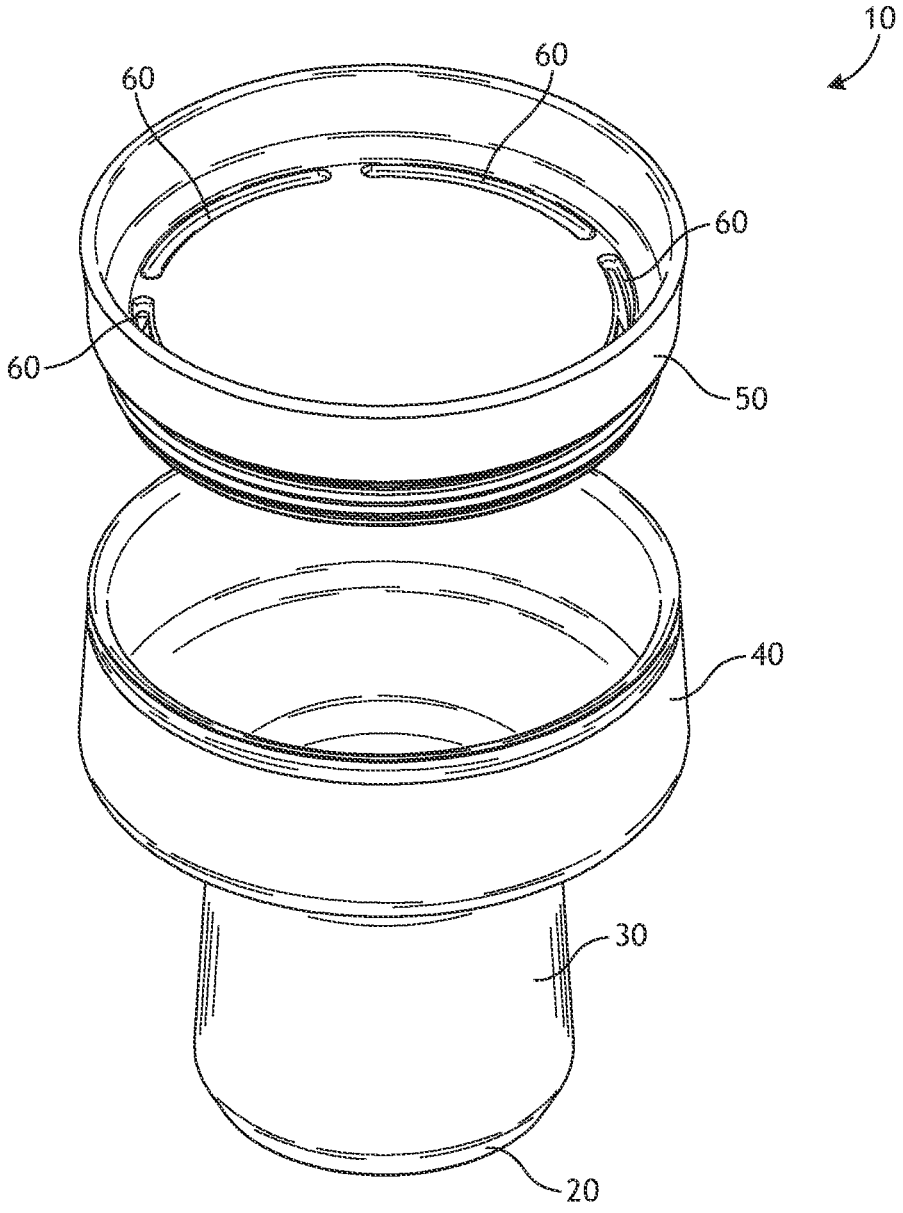
FIG. 8 is an exploded, front side perspective view of a drinking vessel with a lid containing circumferential drinking openings.

FIG. 8 is an exploded, front side perspective view of a drinking vessel with a lid containing circumferential drinking openings. This embodiment shows that base 20, stem 30, and bowl 40 consist of the same unitary component, whereas lid 50 is a separate component. Lid 50 can be attached to the combination of base 20, stem 30, and bowl 40 by any suitable means, such as a threaded connection (see FIG. 9), seals, snap-on, or otherwise as those skilled in the art will appreciate. As further illustrated by this embodiment of FIG. 8, liquid may be housed by both stem 30 and bowl 40.

Figure 9:
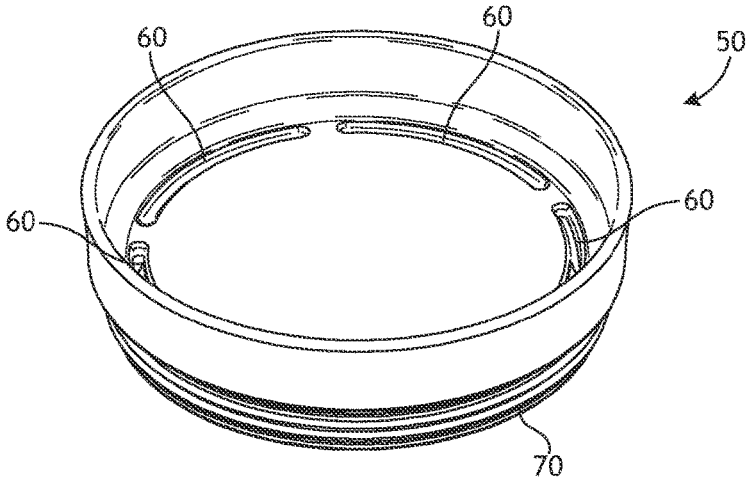
FIG. 9 is a front-side perspective view of one embodiment of a lid containing circumferential drinking openings.

FIG. 9 is a front-side perspective view of one embodiment of a lid containing circumferential drinking openings. Specifically, as FIG. 9 shows, lid 50 may include a plurality of drinking openings 60 arranged around a periphery of lid 50. The arced, slit-like openings 60 and their arrangement in lid 50 enable a user to sip from the vessel substantially irrespective of the vessel's rotational orientation. As indicated above, lid 50 may be attached to bowl 40 via threads 70, although other connection mechanisms known in the art are possible.

Figure 10:
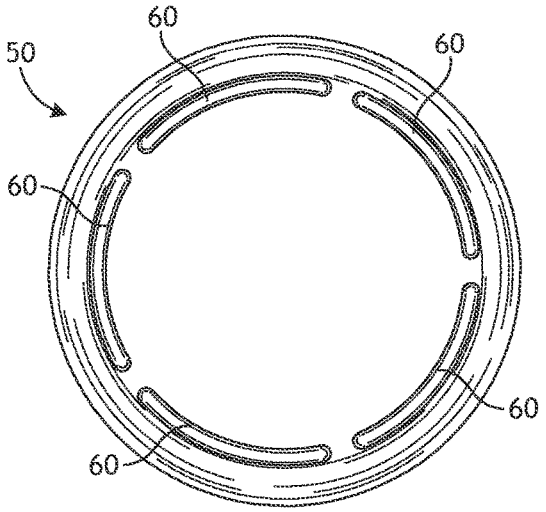
FIG. 10 is a top view of one embodiment of a lid containing circumferential drinking openings.
Figure 11:
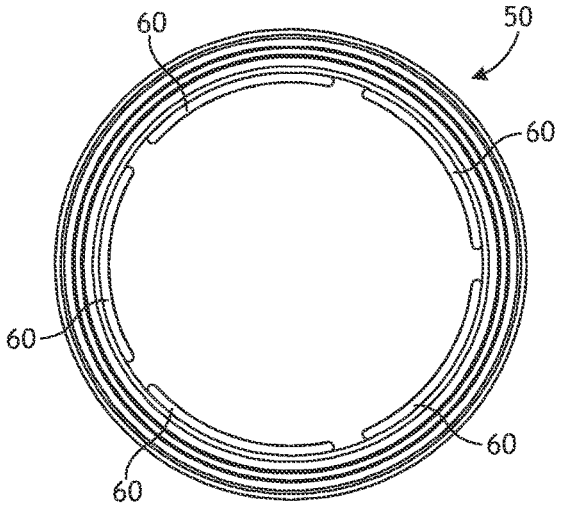
FIG. 11 is a bottom view of one embodiment of a lid containing circumferential drinking openings.
Figure 12:
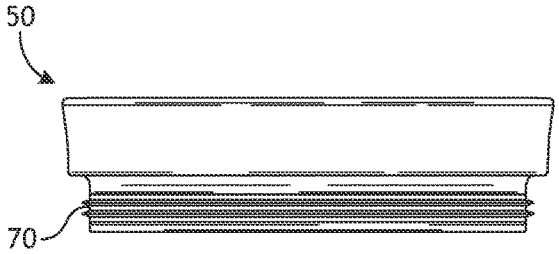
FIG. 12 is a back view of one embodiment of a lid containing circumferential drinking openings.
Figure 13:
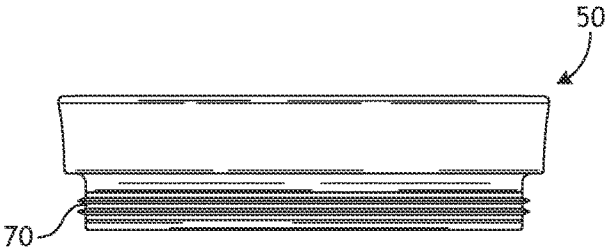
FIG. 13 is a front view of one embodiment of a lid containing circumferential drinking openings.
Figure 14:
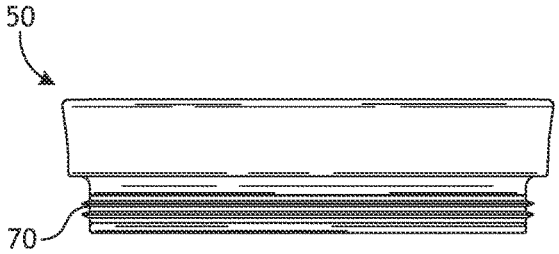
FIG. 14 is a left side view of one embodiment of a lid containing circumferential drinking openings.
Figure 15:
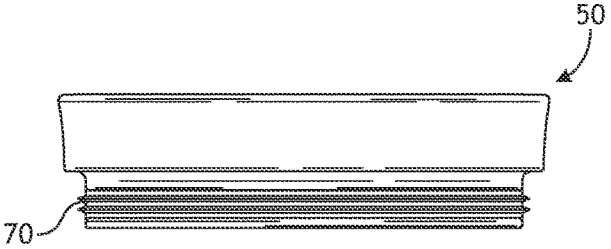
FIG. 15 is a right side view of one embodiment of a lid containing circumferential drinking openings.

FIG. 10 is a top view of one embodiment of a lid containing circumferential drinking openings. FIG. 11 is a bottom view of one embodiment of a lid containing circumferential drinking openings. FIGS. 10-11 likewise illustrate the arced, slit-like openings 60 and their arrangement on a periphery of lid 50 so as to enable a user to sip from the associated vessel substantially irrespective of the vessel's rotational orientation. FIGS. 12-15 further illustrate an embodiment of a lid containing circumferential drinking openings. Specifically, FIG. 12 is a back view, FIG. 13 is a front view, FIG. 14 is a left side view, and FIG. 15 is a right side view.

Figure 16:
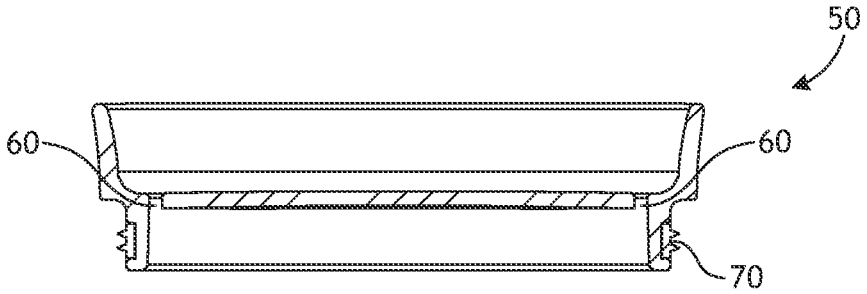
FIG. 16 is a cross section view of one embodiment of a lid containing circumferential drinking openings.

FIG. 16 is a cross section view of one embodiment of a lid containing circumferential drinking openings. FIG. 16 illustrates drinking openings 60 spaced substantially to the outside periphery of lid 50, although as noted above they need not be spaced as such. Instead, they could be spaced anywhere between the center and outside periphery of lid 50. FIG. 16 also shows threads 70, but other attachment mechanisms are within the scope of the present invention. Finally, FIG. 16 illustrates the optional feature of lid 50 including a raised rim above drinking openings 60 and substantially surrounding the outside circumference of lid 50 so as to retain any liquid inadvertently spilled from the associated container.

Figure 17:
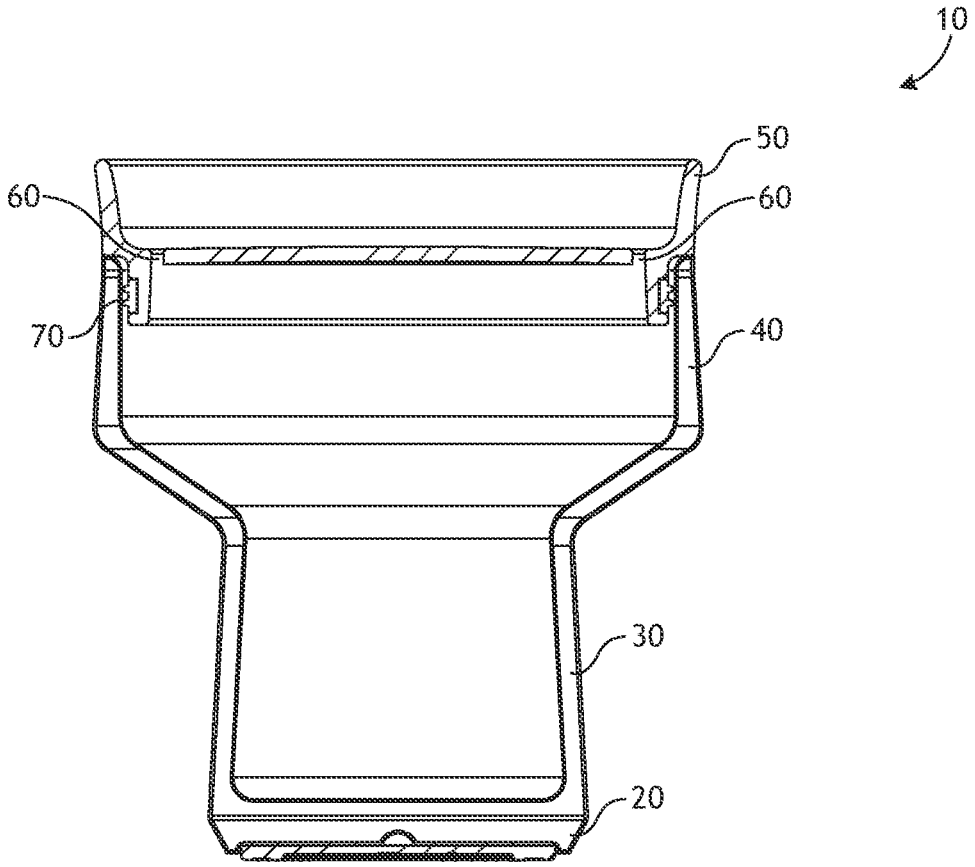
FIG. 17 is a cross section view of one embodiment of a drinking vessel with a lid containing circumferential drinking openings.

FIG. 17 is a cross section view of one embodiment of a drinking vessel with a lid containing circumferential drinking openings. FIG. 17 illustrates that combination 10 may include base 20, stem 30, bowl 40, and lid 50. An opening on bowl 40 is sized to receive lid 50 in a sealing arrangement that substantially prevents the contents of bowl 40 from inadvertently escaping/spilling. Instead, liquid contained in bowl 40 and/or stem 30 exits container 10 via drinking openings 60 as described above. Finally, FIG. 17 further illustrates an exemplary representation of the various circumferences of base 20, stem 30, bowl 40, and lid 50.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

Accordingly, the protection sought herein is as set forth in the claims below.

The invention claimed is:

1. A drinking container, comprising:

a base including a first circumference and a second circumference, wherein the second circumference of the base is greater than the first circumference of the base;

a stem including a first circumference and a second circumference, wherein the second circumference of the stem is less than the first circumference of the stem, wherein the first circumference of the stem includes an interface with the second circumference of the base, and wherein the first circumference of the stem is equal to the second circumference of the base at the interface between the first circumference of the stem and the second circumference of the base;

a bowl including a first circumference and a second circumference, wherein the second circumference of the bowl is greater than the first circumference of the bowl, wherein the first circumference of the bowl includes an interface with the second circumference of the stem, and the first circumference of the bowl is equal to the second circumference of the stem at the interface between the first circumference of the bowl and the second circumference of the stem;

a transition between the first circumference and the second circumference of the bowl, wherein the transition includes a third circumference greater than the first and second circumference of the bowl, and wherein the transition provides support to a user when holding the drinking container; and a lid including a first circumference and a second circumference, wherein the second circumference of the lid is greater than the first circumference of the lid, wherein the first circumference of the lid includes an interface with the second circumference of the bowl, and the first circumference of the lid is equal to the second circumference of the bowl at the interface between the first circumference of the lid and the second circumference of the bowl, wherein the bowl is connected to the lid and wherein the container includes a plurality of rotational orientations, wherein the lid further includes a plurality of fully unobstructed drinking openings located around a periphery of a top surface of the lid such that there are drinking openings adjacent one another and opposite one another, such that a user may drink from the container substantially irrespective of its rotational orientation, and wherein the top surface of the lid is flat between each of the drinking openings located opposite one another on the periphery of the lid.

2. The drinking container of claim 1 wherein the plurality of drinking openings are arced slits.

3. The drinking container of claim 2 wherein a gap exists between one or more of the arced slits.

4. The drinking container of claim 3 wherein each arced slit has a curvature equal to the other arced slits.

5. The drinking container of claim 4 wherein the lid includes a raised rim.

6. The drinking container of claim 5 wherein the raised rim is on a periphery of the lid.

7. The drinking container of claim 6 wherein the raised rim is located on the lid above the plurality of drinking openings.

8. The drinking container of claim 7 wherein the bowl is adapted to contain a liquid.

9. The drinking container of claim 8 wherein the stem is connected to the bowl.

10. The drinking container of claim 9 wherein the stem is adapted to contain a liquid.

11. The drinking container of claim 10 wherein the bowl is connected to the lid by a threaded connection.

12. The drinking container of claim 11 wherein the bowl is vacuum sealed.

13. The drinking container of claim 12 wherein the bowl and stem are vacuum sealed.

14. The drinking container of claim 13 wherein the lid is vacuum sealed.

15. The drinking container of claim 14 wherein the plurality of arced slits are elongated arched slits such that five of said slits substantially fill the periphery of the lid.

* * * * *